US005499634A

United States Patent [19]

Herrmann

[11] Patent Number: 5,499,634

[45] Date of Patent: Mar. 19, 1996

[54] CIGARETTE SNUFFER

[76] Inventor: Dale Herrmann, N84 W16033 Menomonee Ave. #210, Menomonee Falls, Wis. 53051

[21] Appl. No.: 407,573

[22] Filed: Mar. 20, 1995

[51] Int. Cl.[6] ..... A24F 13/18

[52] U.S. Cl. ..... 131/256; 206/496

[58] Field of Search ..... 131/256, 235.1, 131/175, 187; 401/102, 195; 206/242, 246, 249, 266, 496

[56] References Cited

U.S. PATENT DOCUMENTS

| | | | |
|---|---|---|---|
| 846,547 | 3/1907 | Brown | 401/102 |
| 939,057 | 11/1909 | Moore | 401/102 |
| 1,764,862 | 12/1926 | Vogelsang . | |
| 2,002,494 | 4/1933 | Eisenberg . | |
| 2,238,503 | 4/1941 | Owen et al. | 131/235.1 |
| 2,246,642 | 6/1941 | Stachowiak | 131/256 |
| 2,319,850 | 12/1941 | Datsko . | |
| 2,371,445 | 3/1942 | Irvin . | |
| 2,715,961 | 8/1955 | Field | 131/256 X |
| 3,978,981 | 9/1976 | Musick . | |
| 5,002,073 | 3/1991 | Chiang | 131/256 X |

*Primary Examiner*—Jennifer Bahr
*Attorney, Agent, or Firm*—Andrus, Sceales, Starke & Sawall

[57] ABSTRACT

A device for extinguishing lighted tobacco products, such as cigarettes and cigars, includes an elongated, tubular cap having a closed, upper end terminating in a cap end wall and an open, upper end, as well as an elongated, tubular holder constructed and arranged to be telescoped within the cap and having an open, upper end and a lower, closed end terminating in a holder end wall opposite the closed, upper end of the cap. The holder has a radially outwardly projecting collar between the open, upper end and the closed, lower end and the cap has a series of longitudinally extending biasing strips located about an inner liner of the cap, the biasing strips being normally biased outwardly towards the longitudinal center line of the cap. The open, upper end of the holder is tapered outwardly in the direction of the closed, lower end thereof and terminates in the collar. The tapered holder is engageable with the biasing strips on the cap as the holder is telescoped within the cap until the open, lower end of the cap abuts the collar on the holder to thereby form a frictional closure between the cap and the holder whereby a lighted tobacco product placed in the holder is extinguished by frictional closure between the cap and the holder.

7 Claims, 1 Drawing Sheet

FIG. 1
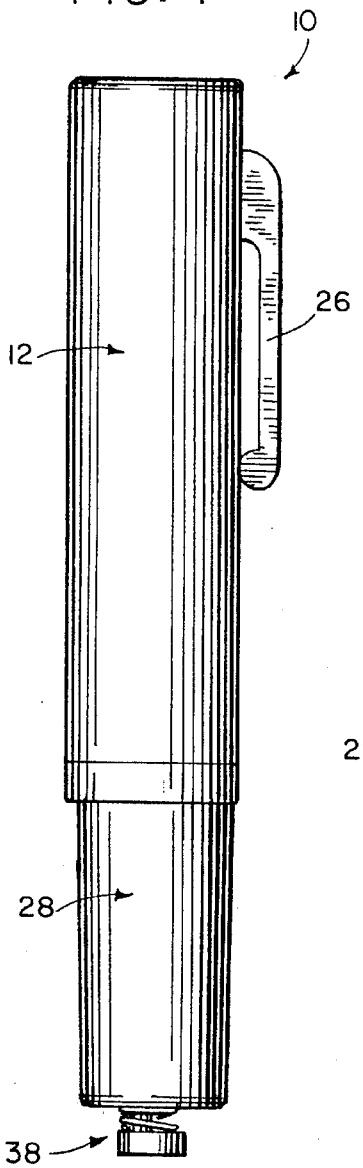
FIG. 2
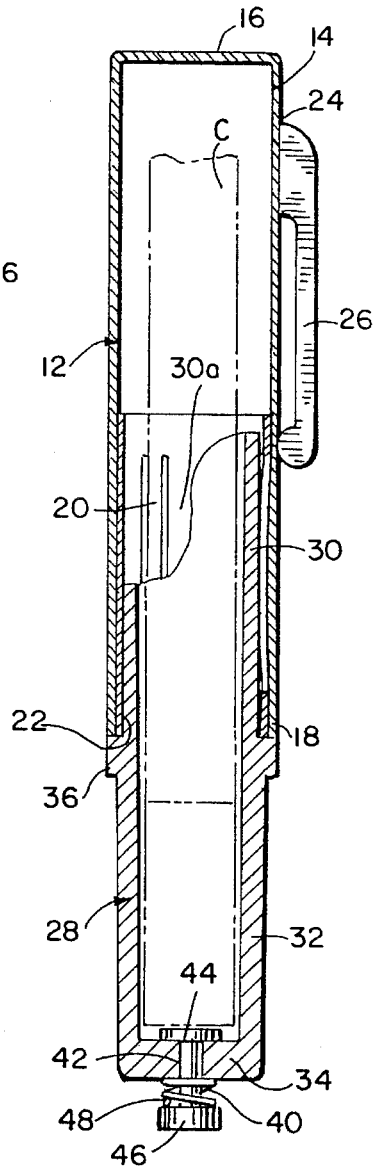
FIG. 3
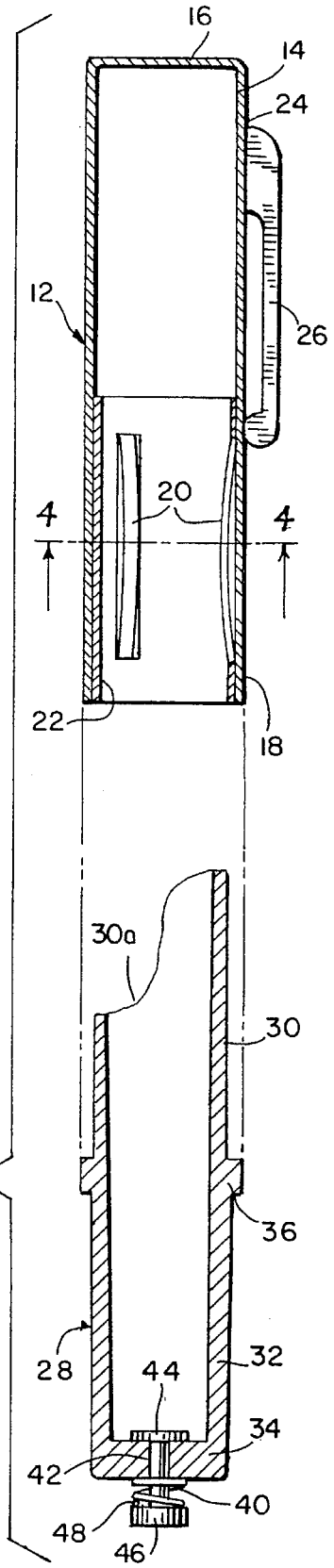
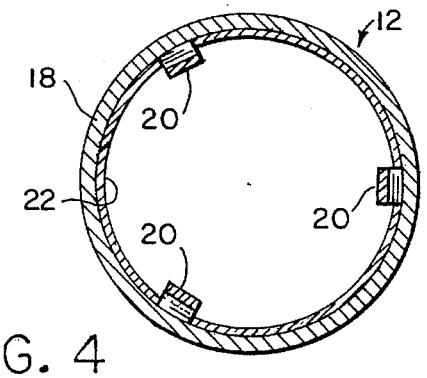
FIG. 4

CIGARETTE SNUFFER

FIELD OF THE INVENTION

This invention relates generally to devices for extinguishing lighted tobacco products, such as cigarettes and cigars, and more particularly, pertains to a device for extinguishing lighted tobacco products which allows a user the option of ejecting the extinguished tobacco product for disposal or reuse.

BACKGROUND OF THE INVENTION

Smokers are very aware of the fact that large volumes of lighted tobacco products, such as cigars, cigarettes and the like, are prematurely extinguished and thrown away before the tobacco products are fully used. Such early disposal is especially prevalent for smokers entering non-smoking environments which are rapidly being established in most public buildings throughout the country. Problems associated with the premature riddance of these lighted tobacco products are most readily evidenced in littering of the environment and increased costs to the smoker for obtaining replacement tobacco goods. In addition, statistics have shown that careless disposal of smoking materials continues to be a leading cause in the number of civilian deaths and injuries resulting from dwelling and home fires.

Various devices for extinguishing lighted tobacco products, known as snuffers, have long been available for providing smokers with tubular members designed to facilitate efficient extinguishing of lighted tobacco products, quick disposal of ashes, and easy removal of the extinguished tobacco product for resmoking. Some of these devices have been constructed of a singular piece such that a lighted tobacco product closely fits the bore of the snuffer so that a minimum of air is available to support combustion. Such snuffers include apertures for allowing smoke to be blown out of the lighted tobacco products and permit venting of undesirable odors while simultaneously providing a means for removing extinguished tobacco products shortened by smoking which have become lodged in lower portions of the snuffer. Other snuffing devices include two members hinged to or telescopic within each other for permitting easy withdrawal of ash and preventing escape of any tobacco product odors.

Such predecessor snuffers have not proved to be entirely effective and convenient to use and it remains desirable to provide an improved snuffing device which will quickly cease burning of and allow easy removal and transport of a tobacco product. It is further desirable to provide a snuffing device which will allow the maximum amount of tobacco product to be resmoked and reduce tile amount of extinguished tobacco products which are deposited on the ground, having been extinguished with one's shoe, or being emptied from one's automobile ashtray.

SUMMARY OF THE INVENTION

The inventive device for extinguishing lighted tobacco products, such as cigarettes and cigars, advantageously provides a relatively simple, effective closure assembly in which lighted tobacco products are quickly snuffed out, stored for reuse and easily removed, all while being conveniently carried on the user.

These and other aspects of the invention are realized in a device for extinguishing lighted tobacco products, such as cigars and cigarettes, comprising an elongated tubular cap having a closed upper end terminating in a cap end wall and an open, upper end as well as an elongated, tubular holder constructed and arranged to be telescoped within the cap and having an open, upper end and a lower, closed end terminating in a holder end wall opposite the closed, upper end of the cap. The holder has a radially outwardly projecting collar between the open, upper end and the closed, lower end and the cap has a series of longitudinally extending biasing strips located about an inner liner of the cap, the biasing strips being normally biased outwardly towards the longitudinal center line of the cap. The open, upper end of the holder is tapered outwardly in the direction of the closed, lower end thereof and terminates in the collar. The tapered holder is engageable with the biasing strips on the cap as the holder is telescoped within the cap until the open, lower end of the cap abuts the collar on the holder to thereby form a frictional closure between the cap and the holder whereby a lighted tobacco product placed in the holder is extinguished by frictional closure between the cap and the holder.

In the preferred form of the invention, the holder end wall is provided with a spring-biased ejector adapted to eject the lighted tobacco product when extinguished from the holder. The ejector includes a shaft extending through the holder end wall, a first button member connected on one end of the shaft and disposed on the inside of the holder end wall, a second button member connected on the other end of the shaft and disposed on the outside of the holder end wall and a spring positioned between the second button member and the outside of the holder end wall and normally biased to hold the first button member against the inside of the holder end wall. With this arrangement, with a lighted tobacco product being extinguished in the holder, pushing of the second button member will cause the first button member to move from the holder end wall and push the tobacco product out of the holder after which the first button member is returned against the holder end wall by the spring.

BRIEF DESCRIPTION OF THE DRAWINGS

The invention will become better understood by reference to the following detailed description of the preferred exemplary embodiment when read in conjunction with the appended drawing wherein like numerals denote like elements; and FIG. 1 is an elevational view of the cigarette snuffer embodying the present invention;

FIG. 2 is a cross-sectional view of the cigarette snuffer shown in FIG. 1;

FIG. 3 is an exploded view of the cigarette snuffer shown in FIG. 2; and FIG. 4 is a cross-sectional view taken on line 4—4 of FIG. 3.

DETAILED DESCRIPTION OF THE PREFERRED EMBODIMENT

Referring now to the drawings, the device for extinguishing lighted tobacco products C, such as cigarettes and cigars, is generally identified by the reference numeral 10. Device 10 comprises an elongated, tubular cap 12 having a closed, upper end 14 terminating in a cap end wall 16 and an open, lower end 18. Cap 12 is provided with a series of three longitudinally extending biasing strips 20 spaced equidistantly about an inner liner 22 of cap 12. Strips 20 are biased and bowed outwardly towards the longitudinal center line of cap 12. Cap 12 has a substantially uniform outer diameter and substantially constant inner diameter throughout its length interrupted only by biasing strips 20. Outer periphery 24 of cap 12 is provided with a longitudinally extending retaining clip 26 adapted to be clipped on the clothing of the user for convenient transport and easy accessibility of the device 10.

Device 10 also includes an elongated, tubular holder 28 constructed and arranged to be telescoped within cap 12 and having an open, upper end 30 partially cut away at 30*a* and a closed, lower end 32 terminating in a holder end wall 34 opposite closed, upper end 14 of cap 12. Holder 28 is provided with a radially outwardly projecting collar 36 located between open, upper end 30 and closed, lower end 32. Outer diameter of open, upper end 30 of holder 28 is also slightly tapered outwardly in the direction of closed, lower end 32 with the tapering terminating in a collar 36. The inner diameter of holder 28 is substantially uniform throughout its length.

With this structure, tapered holder 28 is engageable with biasing strips 20 on cap 12 as holder 28 is telescoped within open, lower end 18 of cap 12 until cap 12 abuts collar 36 on holder 28 to thereby form a frictional closure between cap 12 and holder 28.

As a feature of the invention, holder end wall 34 is provided with an ejector 38 adapted to eject the lighted tobacco product C when extinguished from holder 28. Ejector 38 includes a shaft 40 extending through a sleeve 42 and holder end wall 34, there being a first button member 44 connected on one end of shaft 40 and disposed on the inside of holder end wall 34. A second button member 46 is connected on the other end of shaft 40 and is disposed on the outside of holder end wall 34. A spring 48 is positioned between second button member 46 and the outside of holder end wall 34 and is normally biased to hold first button member 44 against inside of holder end wall 34. As a result, when a lighted tobacco product C being extinguished in holder 28, pushing of second button member 46 will cause first member 44 to move from holder end wall 34 and urge tobacco product C out of holder 28 after which first button member 44 is returned against holder end wall 34 by spring 48.

In use, a smoker bearing device 10, and wishing to extinguish a lighted tobacco product C, pulls holder 28 out of frictional contact with cap 12, inserts the lighted tobacco product C, lighted end first into holder 28, against first button member 44 and then places cap 12 back on holder 28. Device 10 is designed such that lighted tobacco product C closely fits the inner diameter thereof so that a minimum amount of air is available to support combustion. Accordingly, the instantaneous extinguishing of the tobacco product C is accomplished, which allows the maximum amount of tobacco product C to be resmoked if desired. At the same time, the inner diameter allows insertion and removal without damaging the outer leaf of paper encasing the tobacco product C. After the lighted tobacco product C has been snuffed out, the tobacco C is stored within device 10 until such time that the smoker desires to resmoke or dispose of tobacco product C. Then, holder 28 is again separated from cap 12 and withdrawal of tobacco product C is easily facilitated by the combination of cutaway portion 30*a* on holder 28 and ejector 38. Any ashes or residue at the holder end wall 34 may be removed by simply tipping the holder 28 upside down.

Devices 10 may be constructed of various materials which will not readily ignite or be seriously impaired due to contact with the burning end of a tobacco product. While the present invention is particularly attractive for use in snuffing out cigarettes, it can be appreciated that it can be adapted for other tobacco products by merely varying the size of the device 10 to match the particular article to be extinguished.

With the structure set forth above, there is provided an improved snuffing device which will quickly cease burning of a lighted tobacco product and allow easy removal and transport of a tobacco product. A marked savings can be accomplished by smokers snuffing out partially burned tobacco products, instead of disposing them, and then resmoking the remaining tobacco product later. In addition, proper use of the present invention will greatly reduce the unwanted littering of extinguished tobacco products and improve the quality of our environment. Proper use of the invention will also reduce the number of mobile home and dwelling fires and their resulting injuries and deaths as caused by careless disposal of lighted tobacco products.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A device for extinguishing lighted tobacco products, said device comprising:

an elongated, tubular cap having a closed, upper end terminating in a cap end wall and an open, lower end;

an elongated, tubular holder constructed and arranged to be telescoped within said cap and having an open, upper end and a closed, lower end terminating in a holder end wall opposite said closed, upper end of said cap, said holder having a radially outwardly projecting collar between said open, upper end and said closed, lower end;

said cap having a series of longitudinally extending biasing strips located about the inner periphery of said cap, said biasing strips being normally biased outwardly towards the longitudinal center line of said cap;

said holder being tapered outwardly in the direction of said closed, lower end thereof, the taper terminating in said collar;

said tapered holder being engageable with said biasing strips on said cap as said holder is telescoped within said cap until said open, lower end of said cap abuts said collar and said holder to thereby form a frictional closure between said cap and said holder, whereby a lighted tobacco product placed in said holder is extinguished by frictional closure between said cap and said holder.

2. The device of claim 1, wherein the outer periphery of said cap is provided with a longitudinally extending retaining clip adapted to maintain the device in a transport position.

3. The device of claim 1, wherein said holder end wall is provided with a spring-biased ejector adapted to eject the lighted tobacco product when extinguished from said holder.

4. The device of claim 3, wherein said ejector includes a shaft extending through said holder end wall, a first button member connected on one end of said shaft and disposed on the inside of said holder end wall, a second button member connected on the other end of said shaft and disposed on the outside of said holder end wall and a spring positioned between said second button member and the outside of said holder end wall and normally biased to hold said first button member against the inside of said holder end wall whereby, with a lighted tobacco product being extinguished in said holder, pushing of said second button member will cause said first button member to move from said holder end wall and push said tobacco product out of said holder after which said first button member is returned against said holder end wall by said spring.

5. The device of claim 1, wherein said cap has an inner diameter and an outer diameter which are substantially uniform throughout its length.

6. The device of claim 1, wherein said holder has an inner diameter substantially uniform throughout its length.

7. The device of claim 1, wherein said open, upper end of said holder is partially cut away to facilitate handling of said tobacco product.

* * * * *